US007309846B2

(12) United States Patent
Haberkamm et al.

(10) Patent No.: US 7,309,846 B2
(45) Date of Patent: Dec. 18, 2007

(54) METHOD FOR OPERATING A BAKING OVEN

(75) Inventors: Ramona Haberkamm, Traunreut (DE); Martin Keller, Traunreut (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/546,788

(22) PCT Filed: Mar. 18, 2004

(86) PCT No.: PCT/EP2004/002859

§ 371 (c)(1),
(2), (4) Date: Aug. 24, 2005

(87) PCT Pub. No.: WO2004/085925

PCT Pub. Date: Oct. 7, 2004

(65) Prior Publication Data

US 2006/0237424 A1 Oct. 26, 2006

(30) Foreign Application Priority Data

Mar. 27, 2003 (DE) ..... 103 13 914

(51) Int. Cl.
*A21B 1/26* (2006.01)
*A21B 1/40* (2006.01)

(52) U.S. Cl. ..... 219/400; 219/413; 219/492; 126/21 A

(58) Field of Classification Search ..... None
See application file for complete search history.

(56) References Cited

U.S. PATENT DOCUMENTS 5,688,422 A * 11/1997 Landwehr et al. ..... 219/412
6,388,235 B1 5/2002 Sauter
6,943,324 B2 * 9/2005 Ahuja ..... 219/446.1
7,009,147 B1 * 3/2006 Schulte ..... 219/400
2004/0040950 A1 * 3/2004 Carbone et al. ..... 219/400

FOREIGN PATENT DOCUMENTS

DE 27 57 059 6/1979
DE 42 17 749 12/1993
DE 100 39 444 2/2002

(Continued)

OTHER PUBLICATIONS

International Search Report PCT/EP2004/002859.

*Primary Examiner*—J. Pelham
(74) *Attorney, Agent, or Firm*—Russell W. Warnock; Craig J. Loest; James E. Howard

(57) ABSTRACT

A baking oven and a method of operating the baking oven. The baking oven including a thermally insulated muffle, a circulating fan arranged inside of a fan compartment in the muffle, a least one heating device outside of the fan compartment and adjacent the walls of the muffle. The baking oven further including a control device for switching the heating device and circulating fan off and on, in accordance with a pre-determined temperature/time profile during the operation of the baking oven. The operation of the baking oven compensates for the difference in temperature between a temperature sensor adjacent a wall of the baking oven and the center of the muffle.

8 Claims, 1 Drawing Sheet

FOREIGN PATENT DOCUMENTS

Figure 1:
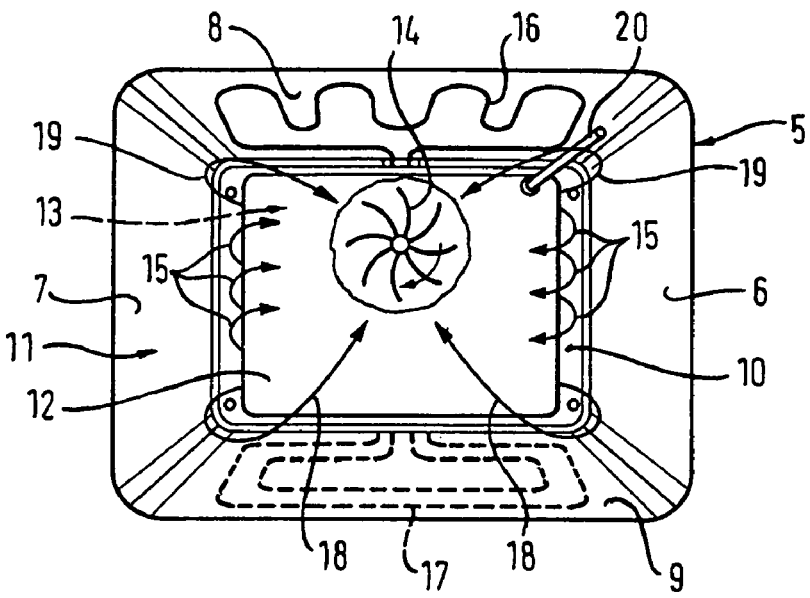

| | | |
|---|---|---|
| EP | 0 351 683 | 1/1990 |
| EP | 0 628 772 | 12/1994 |
| EP | 0 768 055 | 4/1997 |
| EP | 0 833 110 | 4/1998 |
| EP | 0 981 961 | 3/2000 |
| EP | 1 201 999 | 5/2002 |
| GB | 2 172 990 | 10/1986 |

* cited by examiner

METHOD FOR OPERATING A BAKING OVEN

The invention relates to a method for operating a baking oven and a baking oven for implementing this method, provided with a closable, thermally insulated muffle, a circulating fan arranged inside a fan compartment of the muffle, at least one heating element arranged close to the walls of the muffle outside the fan compartment and a control device by which means the at least one heating element and the circulating fan can be switched on and off according to a pre-determined temperature/time profile during the operation of the baking oven, which consists of a pre-heating phase and a continuous-heating phase.

A baking oven with a circulating fan arranged in a rear fan compartment of the muffle and thermal heating elements in the form of an overheat and an underheat arranged outside this fan compartment is known (DE 19640237A1).

Various operating modes of such baking ovens are known wherein a so-called pre-heating phase is carried out to heat the baking oven from room temperature to a selectable cooking temperature and after a baking oven temperature close to the desired temperature has been reached, a control device switches over to a continuous-heating phase. In order to shorten the total duration of the baking oven operation, attempts are frequently made to keep the pre-heating phase as short as possible. Thus, in a known method for cooking in a hot-air appliance (DE 3510680C2), prior to a continuous-heating phase with a plurality of intermediate heating phases, a pre-heating phase is carried out with the circulating fan switched on permanently and the heating elements switched on permanently in order to bring as much thermal energy into the cooking compartment in the shortest possible time. The circulating fan is then switched on cyclically with the heating switched off in the time between the individual intermediate heating phases.

Experiments have now shown that as a result of the biochemical processes already taking place in the food during the pre-heating phase, it is of essential importance for the baking result, especially when a negative profile can be identified on heating element patterns, e.g. on flat baked goods, that a treatment temperature (continuous heating temperature) at least close to the set desired temperature is reached at the time of switching over from the pre-heating phase to the continuous heating phase in the treatment centre of the baking oven, that is approximately in its central region. This cannot be optimally achieved in known baking ovens especially because as a result of the continuously improving thermal insulation of the baking ovens, natural convection no longer takes place in the baking oven to any significant extent and as a result of the usually non-central arrangement of the temperature sensor of the control device, a not insignificant temperature difference exists between the temperature measured at the temperature sensor and which determines the function of the control device, and the temperature at the centre of the baking oven which determines the baking result. Especially in so-called conventional operating modes where the circulating air is heated exclusively by an overheat and/or an underheat, i.e., by heating elements outside the fan compartment, this temperature difference is so great that at the end of the pre-heating phase and thus at the beginning of the actual control phase during the continuous heating phase, very unfavourable relationships prevail for the beginning of the continuous heating phase.

It is thus the object of the present invention to configure a method for operating a baking oven of the type specified initially such that by simple control technology means, a cooking temperature as close as possible to the set desired temperature can be maintained at the end of the pre-heating phase, i.e., when switching off the heating element(s) at the beginning of the continuous heating control phase at the centre of the muffle.

This object is solved according to the invention in a method of the type described initially in that during the pre-heating phase the at least one heating element is preferably continuously switched on and the circulating fan is temporarily switched on according to a time profile which is at least partially dependent on the pre-determined switching-off temperature of the heating element at the end of the pre-heating phase. This single or multiple switching-on of the circulating fan is preferably only brief, e.g. with a switch-on time of about 30 seconds.

The method according to the invention forces convection of the initially spatially only more or less non-uniformly distributed heated circulating air during the pre-heating phase in the muffle which results in a more uniform heat distribution in the muffle compartment. As a result, a very small temperature difference, if at all, is obtained between the temperature measured at the temperature sensor, i.e., outside the centre of the muffle and the temperature at the centre of the muffle, that is in the vicinity of the food to be treated. An overshoot of the temperature above the selected desired temperature usually observed as a result of the temperature sensor mostly not being located in the immediate radiation area of the heating elements (e.g. overheat, underheat) is thus substantially reduced or prevented. The consequence is that within the continuous heating phase the actual temperature at the centre of the muffle adapts very rapidly to the ideal temperature profile.

According to an advantageous embodiment of the method according to the invention, during the pre-heating phase the circulating fan is switched on at least once at a time which depends on the level of the switching-off temperature and/or the operating mode and arrangement of the at least one heating element and at least once more at a time which depends on the temperature gradient of the respective pre-heating profile. Naturally, advantages are also obtained by using the aforesaid method features separately. Especially as a result of the time of the second or further temporary switch-on of the circulating fan depending on the aforesaid temperature gradient, account is taken of the fact that a temperature rise in the lower temperature range takes place faster than in a high temperature range. The time profile during the pre-heating phase is advantageously made to depend on the operating mode of the baking oven, e.g., using one or a plurality of heating elements and on the arrangement of the heating element(s) relative to the temperature sensor.

The invention is explained hereinafter with reference to an exemplary embodiment shown in the drawings.

Figure 2:
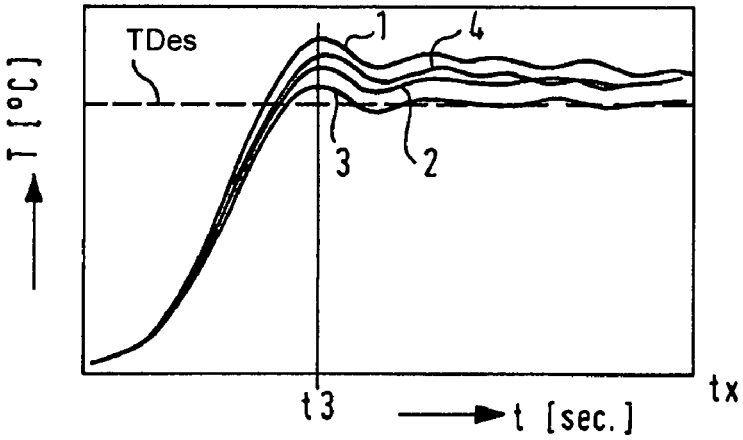
Figure 3:
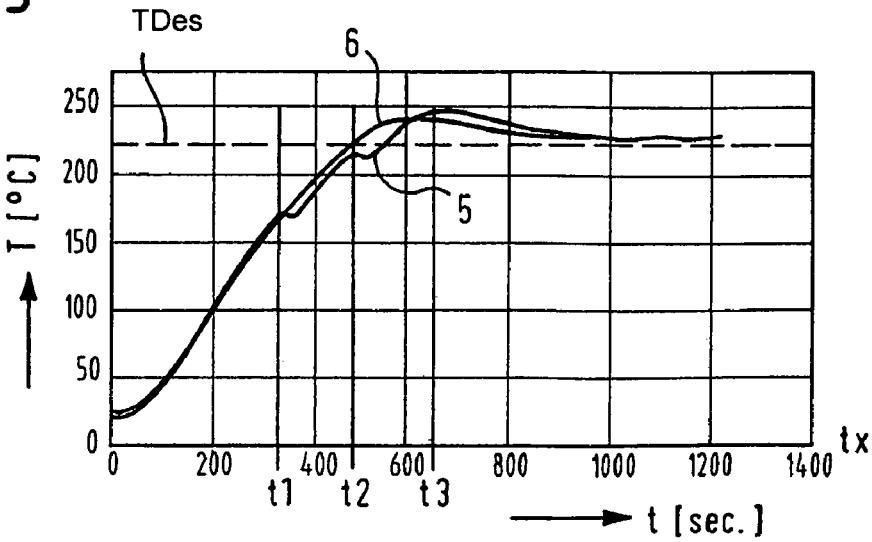

In the figures:

FIG. 1 is a schematic diagram of a baking oven for implementing the method according to the invention, FIG. 2 is a diagram showing the time-temperature profile of different operating sequences of the baking oven, FIG. 3 is a diagram showing the time-temperature profile according to the method according to the invention.

FIG. 1 is a schematic and perspective diagram of the rectangular baking chamber 5 of a baking oven, comprising side muffle walls 6, 7, an upper muffle wall 8, a lower muffle wall 9 and a rearward, perpendicular muffle wall 10. Located at the rearward end of the muffle compartment 11 at a distance from the rear muffle wall 10 is an intermediate wall 12 which forms a fan compartment 13 largely separate from the remaining muffle compartment, which accommodates a motor-driven circulating fan 14. This fan compartment communicates with the remaining muffle compartment 11 via lateral outlet openings which are not shown further, and are indicated in FIG. 1 by air flow arrows 15. Located inside the muffle compartment 11 and in the immediate vicinity of the upper muffle wall 8 is a heating element 16 embodied as a radiant heater, also known as overheat, whilst a further heating element 17 is located as so-called underheat underneath the lower muffle wall 9. Air flow arrows 18 and 19 in FIG. 1 indicate that air flows emerging from the circulating fan 14 flow in the direction of the afore-mentioned heating elements 16, 17, are heated there at the heating elements or at the adjacent muffle walls and are extracted again by the circulating fan 14 via a central extraction opening in the intermediate wall 12 of the fan compartment 13. In this case, operation of heating elements inside the fan compartment 13 is not provided. Also located in the muffle compartment 11 is a temperature sensor 20 which is spatially and functionally connected to a control device for the baking oven, not shown in further detail, but usual per se. This temperature sensor 20 is located near the upper muffle wall 8 and is for example fixed to the rearward muffle wall 10 and penetrates the intermediate wall 12 of the fan compartment 13. Thus, this temperature sensor 20 is located, as usual, far outside the treatment centre of the baking chamber 5 where the food to be treated is located. The baking chamber 5 is surrounded by a thermal insulating compound not shown and can also be tightly sealed during operation of the baking oven by an oven door not shown.

FIG. 2 shows the problem with which the present invention is concerned using a family of curves. The diagram shows, in the same way as FIG. 3, the process sequence of the baking oven where the abscissa is the time axis and the ordinate is the temperature axis. The family of curves shows curve 1 which indicates the real temperature profile at the temperature sensor 20 arranged outside the treatment centre of the baking chamber 5 (FIG. 1) without the circulating fan 14 being switched on during the pre-heating phase 0-t3, i.e. only the heating elements 16, 17 are continuously switched on. The time t3 is the point in the temperature/time profile at which the heating elements 16, 17 are switched off for the first time on reaching the heating peak (switching-off temperature, the pre-heating phase is ended and the continuous heating phase t3-tx begins with known, cyclic regulating play of heating elements and circulating fan, controlled by a conventional control device which is not shown.

FIG. 2 shows a desired ideal behaviour of the temperature profile at the temperature sensor in relation to a selected desired temperature $T_{des}$ in the treatment centre which at time t3 is relative far from the real measured temperature at the temperature sensor, i.e., an overshoot of the measured temperature at the temperature sensor compared with the ideal temperature takes place. The curves in FIG. 2 clearly show that during the continuous heating phase t3-tx a relatively large amount of time would be lost to achieve the ideal temperature behaviour of curve 2 in the range tx in the operating mode according to curve 1.

Curve 3 should indicate the ideal temperature behaviour in the treatment centre of the baking oven where no temperature sensor for the control device is located in the treatment centre. At time t3 this ideal treatment temperature is at least largely approximated to the desired temperature Tdes and there is only a minimal difference from the ideal temperature of the ideal curve 2 at this time t3.

Curve 4 illustrates a corrected temperature/time profile according to the invention described where the temperature behaviour at the temperature sensor 20 at time t3 approaches the ideal temperature behaviour according to curve 2 as a result of the preferably multiple cyclic operation of the circulating fan 14 (FIG. 1). As a consequence, in the continuous heating phases t3-tx the corrected temperature behaviour reaches the ideal temperature behaviour in a shorter time, as is clearly shown in FIG. 2.

Such a temperature/time profile is illustrated by curve 5 in FIG. 3. In this case during the pre-heating phase 0-t3 the circulating fan 14 (FIG. 1) is switched on temporarily at times t1 and t2, e.g. for 30 seconds. In contrast thereto, curve 6 in FIG. 3 shows the temperature/time profile that would be obtained without the method according to the invention, i.e. the pre-heating curve would rise continuously and uninterruptedly as far as the switching-off point on reaching a pre-heating peak at the end of the pre-heating phase. Curve 5 on the other hand clearly illustrates the aforementioned cyclic operation of the circulating fan at the times t1 and t2. This produces the advantageous effect that the temperature rise at the temperature sensor located outside the treatment centre of the baking oven which is responsible for regulating the temperature and ultimately for the baking result, is briefly slowed at each cyclic operation at t1 and t2 (curve 5) as can be seen from the brief interruption of the otherwise linear temperature rise (temperature gradient) i.e. at the partially loop-shaped profile of curve 5 at the level of time Z1 and t2 so that it is possible for the temperature in the treatment centre to compensate for the prevailing temperature difference between the temperature sensor and the treatment centre as a result of the brief forced air convection.

With regard to control technology, the ideal time profile according to the invention is achieved if the time profile is determined by the level of the switching-off temperature at t3 and/or by the operating mode and arrangement of the heating elements 16, 17 (FIG. 1). This first switching-on time t1 in the time profile is preferably a fixed percentage relative to the heating peak or the switching-off temperature at the end of the pre-heating phase 0-t3. The second switching-on time t2 is preferably determined by the temperature gradient of the respective pre-heating profile which depends on the selected desired or switchihg-off temperature.

The advantages of the present invention are naturally obtained equally if the temperature at the temperature sensor is temporally in advance of the temperature in the treatment centre and also conversely if the temperature at the temperature sensor is temporally lagging compared with the temperature in the treatment centre.

The invention claimed is:

1. A method for operating a baking oven provided with a closable, thermally insulated muffle, comprising:

a circulating fan arranged inside a fan compartment formed in the muffle;

at least one heating element arranged close to the walls of said muffle outside said fan compartment;

a control device for switching on and off said heating element and said circulating fan according to a predetermined temperature/time profile during operation of the baking oven;

said operation including a pre-heating phase (0-t3) and a continuous-heating phase (t3-tx);

continuously switching on said heating element during said pre-heating phase (0-t3); and temporarily switching on said circulating fan according to a time profile which is at least partially dependent on said pre-determined switching-off temperature of said heating element at the end of said pre-heating phase and which ends at a time before the end of said pre-heating phase.

2. The method according to claim 1 including determining said time profile by the level of the switching-on temperature and/or the operating mode and arrangement of said heating element.

3. The method according to claim 1 including determining said time profile by the temperature gradient of the respective pre-heating profile which depends on the selected desired switching-off temperature.

4. The method according to claim 1 including switching said circulating fan on briefly at least twice during said pre-heating phase (0-t3).

5. The method according to claim 1 including switching said circulating fan on during said pre-heating phase (0-t3) at least once at a time which depends on at least one of the level of said switching-off temperature and said operating mode and arrangement of said one heating element and including switching said circulating fan on at least once more at a time which depends on the temperature gradient of the respective pre-heating profile.

6. A baking oven, comprising:

a thermally insulated, closable muffle;

a fan compartment including a circulating fan and at least one thermal heating element provided close to the muffle walls outside said fan compartment;

a control device;

a temperature sensor located outside a treatment center of said muffle coupled to said control device;

said control device operated such that said circulating fan is temporarily switched on according to a time profile which depends at least partially on a pre-determined switching-off temperature of said heating element at the end of a pre-heating phase (t3) during a pre-heating phase (0-t3) of said muffle preceding a continuous-heating phase (t3-tx) of said muffle and said control device determines said time profile by the temperature gradient of the respective pre-heating profile which depends on the selected desired switching-off temperature.

7. The baking oven according to claim 6, including said control device determines said time profile by the level of at least one of the switching-on temperature and the operating mode and arrangement of said heating element.

8. The baking oven according to claim 6, including said control device switching said circulating fan on during said pre-heating phase (0-t3) at least once at a time which depends on at least one of the level of said switching-off temperature and said operating mode and arrangement of said one heating element and including said control device switching said circulating fan on at least once more at a time which depends on the temperature gradient of the respective pre-heating profile.

* * * * *